US007686592B2

(12) United States Patent
Inoue et al.

(10) Patent No.: US 7,686,592 B2
(45) Date of Patent: Mar. 30, 2010

(54) COMPRESSOR

(75) Inventors: Akira Inoue, Kanagawa (JP); Seigo Yanase, Kanagawa (JP); Kiwamu Watanabe, Kanagawa (JP); Hidenori Kobayashi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1013 days.

(21) Appl. No.: 10/576,480

(22) PCT Filed: Nov. 21, 2005

(86) PCT No.: PCT/JP2005/021741

§ 371 (c)(1),
(2), (4) Date: Apr. 21, 2006

(87) PCT Pub. No.: WO2006/054800

PCT Pub. Date: May 26, 2006

(65) Prior Publication Data

US 2009/0104050 A1 Apr. 23, 2009

(30) Foreign Application Priority Data

Nov. 22, 2004 (JP) ..... 2004-337109

(51) Int. Cl.
*F04B 39/00* (2006.01)
*F04B 53/00* (2006.01)

(52) U.S. Cl. ..... 417/312; 181/229; 181/403

(58) Field of Classification Search ..... 417/312, 417/902; 181/229, 403
See application file for complete search history.

(56) References Cited

U.S. PATENT DOCUMENTS

| | | | | | |
|---|---|---|---|---|---|
| 3,712,416 | A * | 1/1973 | Swanson et al. | ..... | 181/229 |
| 4,313,715 | A * | 2/1982 | Richardson, Jr. | ..... | 417/312 |
| 4,370,104 | A * | 1/1983 | Nelson et al. | ..... | 417/312 |
| 5,288,212 | A * | 2/1994 | Lee | ..... | 417/312 |
| 5,496,156 | A * | 3/1996 | Harper et al. | ..... | 417/312 |
| 5,804,777 | A * | 9/1998 | Kim et al. | ..... | 181/229 |
| 6,129,522 | A * | 10/2000 | Seo | ..... | 417/312 |
| 2005/0129534 | A1 * | 6/2005 | Lee | ..... | 417/312 |

FOREIGN PATENT DOCUMENTS

| | | | |
|---|---|---|---|
| JP | 2000-130327 | A | 5/2000 |
| JP | 2002-161855 | A | 6/2002 |
| WO | WO 2004/085849 | A | 10/2004 |

OTHER PUBLICATIONS

International Search Report for PCT/JP2005/021741, dated Feb. 2, 2006.

* cited by examiner

*Primary Examiner*—Devon C Kramer
*Assistant Examiner*—Peter J Bertheaud
(74) *Attorney, Agent, or Firm*—RatnerPrestia

(57) ABSTRACT

A suction muffler receives low-temperature refrigerant gas discharged into a hermetic container from a suction pipe by a gas catcher, and feeds the gas to a compressor. The lower end of an opening of the gas catcher is located at a position lower than the lower end of an orifice of the suction pipe so as to catch the refrigerant gas falling obliquely downward inside the hermetic container.

2 Claims, 6 Drawing Sheets

COMPRESSOR

THIS APPLICATION IS A U.S. NATIONAL PHASE APPLICATION OF PCT INTERNATIONAL APPLICATION PCT/JP2005/021741.

TECHNICAL FIELD

The present invention relates to compressors for refrigeration units, and more particularly to compressors provided with a suction muffler in an intake passage of refrigerant gas.

BACKGROUND ART

FIG. 7 is a sectional view of a conventional compressor disclosed in Japanese Patent Unexamined Publication No. 2002-161855. FIG. 8 is a front sectional view of a suction muffler used in the conventional compressor. In hermetic container 1, supporter 5 resiliently supports compression element 2 and motor 3 which drives compression element 2. Compression element 2 includes cylinder 6, piston 8 which reciprocates inside cylinder 6, compression chamber 9 formed inside cylinder 6, and inlet hole 24 on compression chamber 9.

Suction pipe 28 fixed to hermetic container 1 draws in refrigerant gas returning to hermetic container 1 from a low-pressure side (not illustrated) of a refrigeration cycle.

Suction muffler 30 made of synthetic resin such as polybutylene terephthalate is attached to compression element 2. Suction muffler 30 includes main body 34 forming muffling space 32, intake port 36 opened to hermetic container 1 and leading to muffling space 32, and gas catcher 38 formed around intake port 36 and opened facing an orifice of suction pipe 28.

When motor 3 is powered, compression element 2 operates and refrigerant gas is compressed by reciprocation of piston 8 inside cylinder 6. In an intake step of compression element 2, the refrigerant gas flowing in through suction pipe 28 from the low-pressure side of the refrigeration cycle is once discharged into hermetic container 1. Then, the refrigerant gas is taken into suction muffler 30 through gas catcher 38, and intermittently drawn into compression chamber 9 through inlet hole 24.

Gas catcher 38 is expected to catch low-temperature refrigerant gas from suction pipe 28 as much as possible. This is because the low-temperature refrigerant gas has high density, and thus refrigerating capacity and efficiency of the compressor improves.

Conventionally, the low-temperature refrigerant gas flowing in from the low-pressure side of the refrigeration cycle is assumed to be discharged horizontally from suction pipe 28. Accordingly, suction pipe 28 and gas catcher 38 are horizontally disposed facing each other.

However, based on our investigation results, the low-temperature refrigerant gas falls obliquely downward in hermetic container 1 because it has high density. Therefore, the conventional configuration allows gas catcher 38 to receive only a part of the refrigerant gas discharged from suction pipe 28.

SUMMARY OF THE INVENTION

A compressor of the present invention includes a suction muffler provided in an intake passage of refrigerant gas. The suction muffler includes a gas catcher which faces a suction pipe discharging the refrigerant gas into a hermetic container and catches the discharged refrigerant gas. A lower end of an opening of the gas catcher is located at a position lower than a lower end of an orifice of the suction pipe so as to catch the refrigerant gas falling obliquely downward in the hermetic container.

DETAILED DESCRIPTION OF THE PREFERRED EMBODIMENTS

A preferred embodiment of the present invention is described below with reference to drawings. It is apparent, however, that the present invention is not limited to the preferred embodiment.

Figure 1:
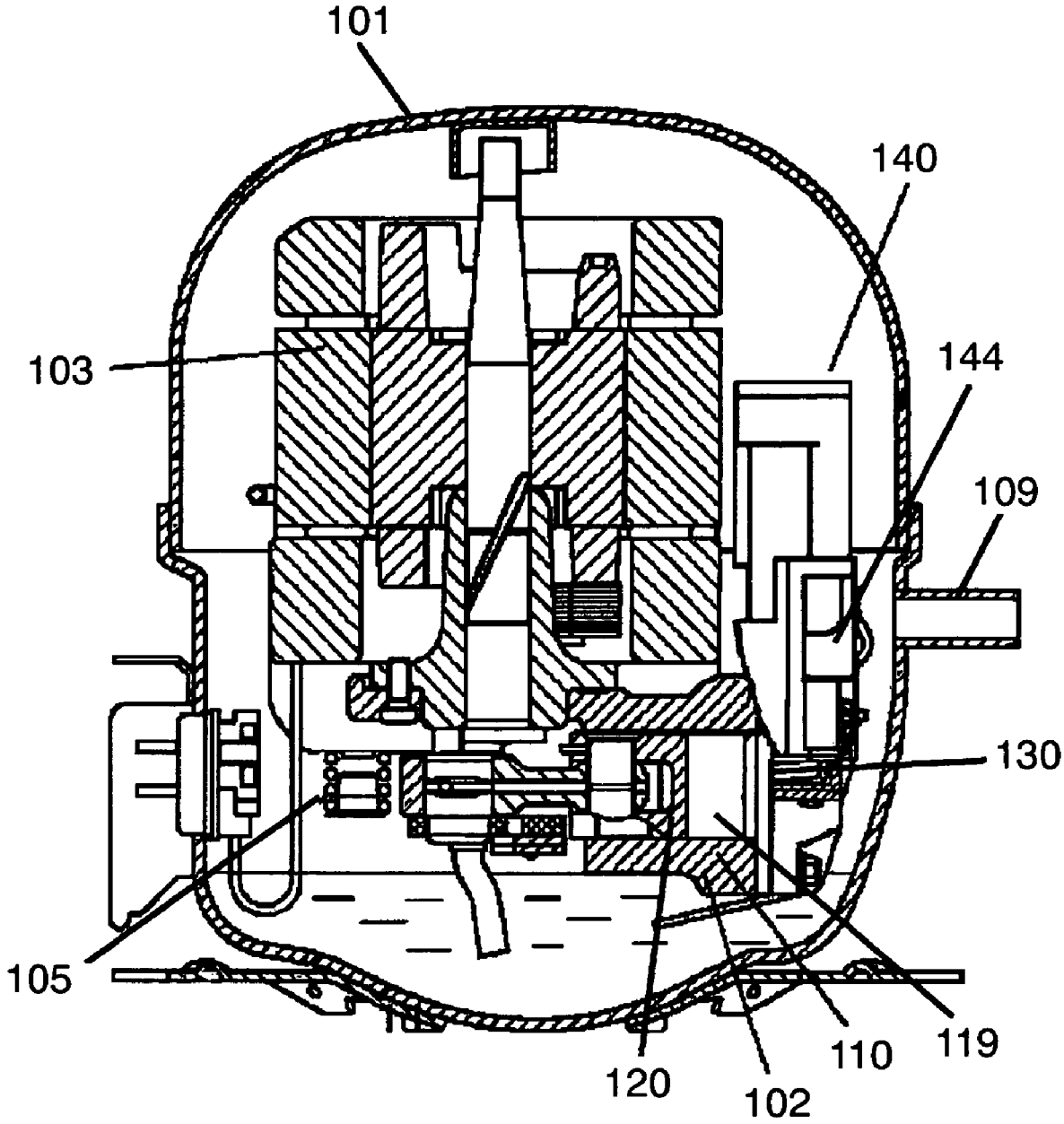
FIG. 1 is a sectional view of a compressor in accordance with a preferred embodiment of the present invention.
Figure 2:
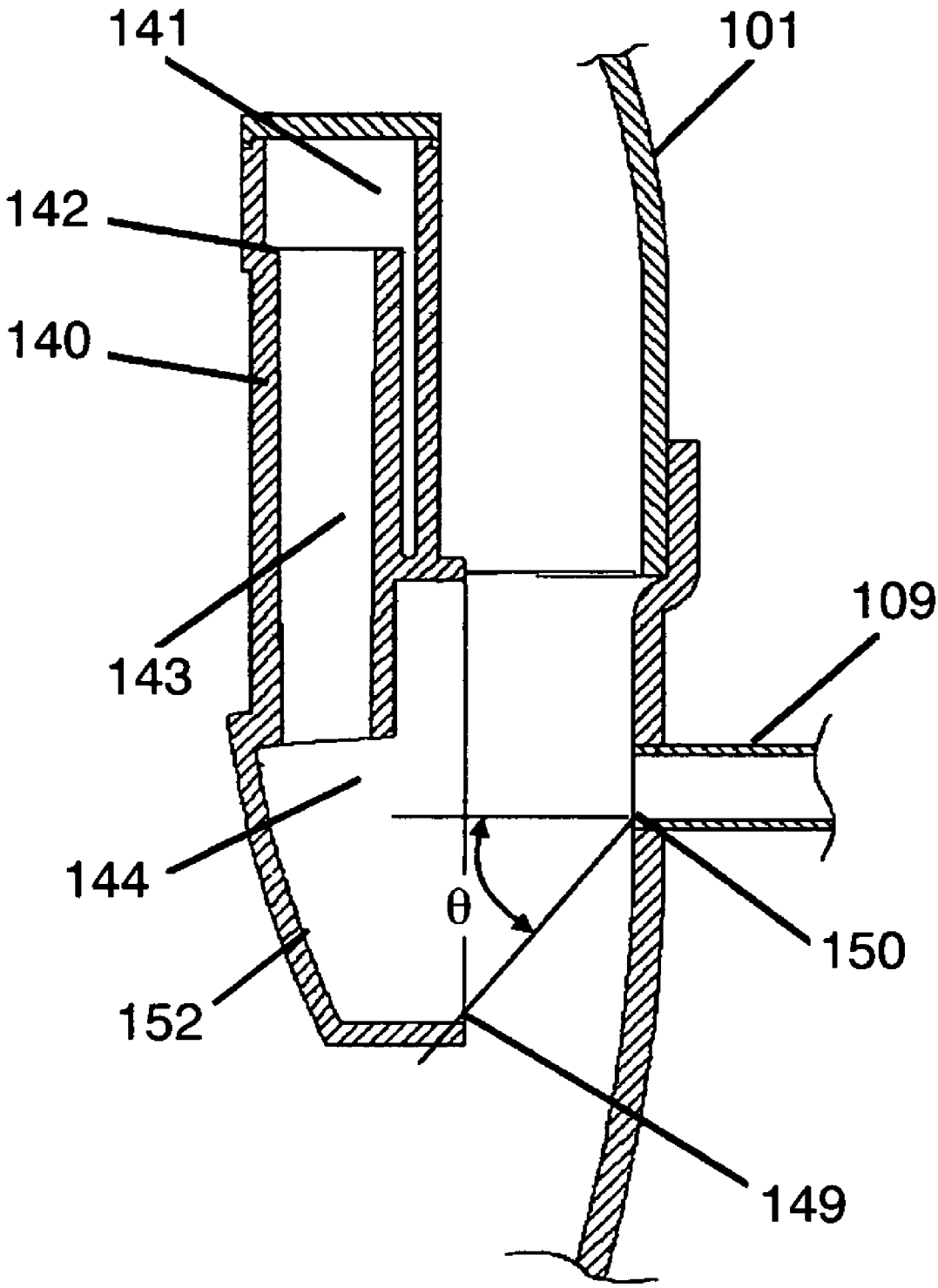
FIG. 2 is a transverse sectional view of a suction muffler and a suction pipe of a hermetic container of the compressor in accordance with the preferred embodiment of the present invention.
Figure 3:
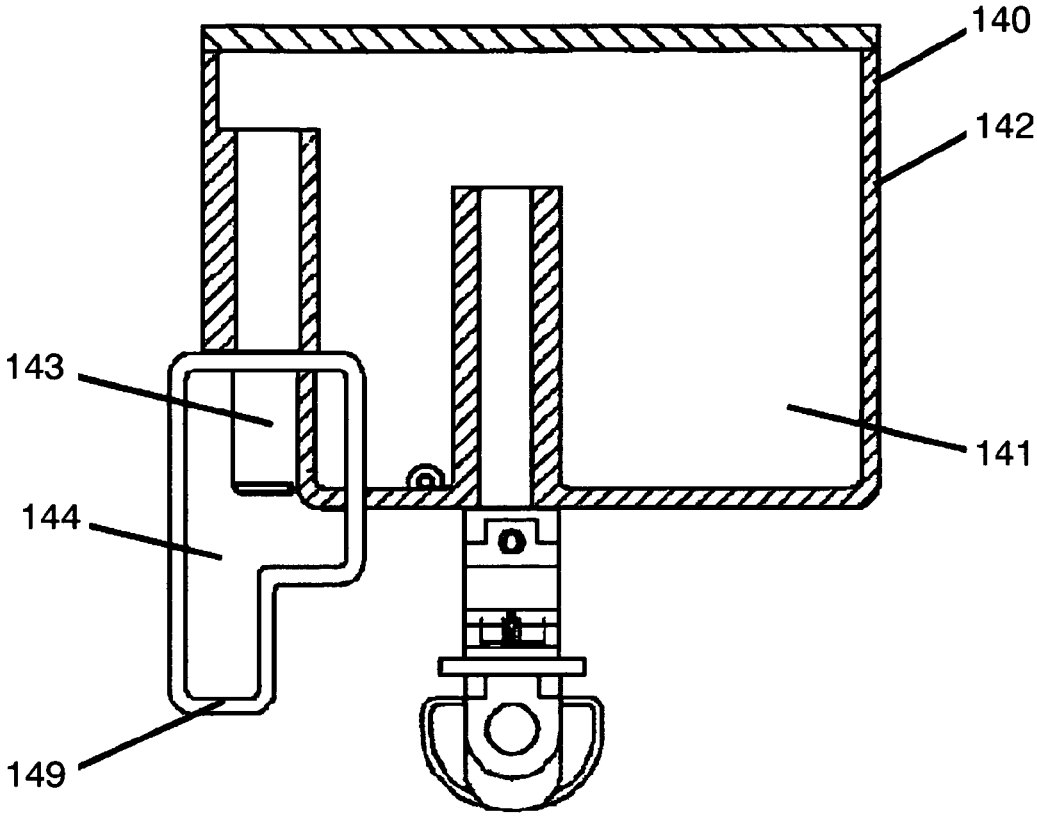
FIG. 3 is a front sectional view of the suction muffler of the compressor in accordance with the preferred embodiment of the present invention.

FIG. 1 is a sectional view of the compressor in the preferred embodiment of the present invention. FIG. 2 is a transverse sectional view of and around a suction muffler employed in the compressor. FIG. 3 is a front sectional view of the suction muffler in FIG. 2.

In hermetic container 101, supporter 105 resiliently supports compression element 102 and motor 103. A space inside hermetic container 101 is filled with refrigerant gas. The refrigerant gas is preferably that conforming to recent environmental requirements such as refrigerant gas R134 and natural refrigerant R600a. Suction pipe 109 fixed to hermetic container 101 takes in the refrigerant gas returning to hermetic container 101 from a lower-pressure side (not illustrated) of a refrigeration cycle.

Compression element 102 includes cylinder 110, piston 120 reciprocating inside cylinder 110, compression chamber 119 formed inside cylinder 110, and inlet hole 130 of compression chamber 119.

Suction muffler 140 whose one end leads to compression chamber 119 of compression element 102 is attached to compression element 102. Suction muffler 140 is made of synthetic resin such as polybutylene terephthalate, and includes main body 142 forming muffling space 141, intake port 143 opened to hermetic container 101 and leading to muffling space 141, and gas catcher 144 surrounding intake port 143 and opened facing an orifice of suction pipe 109. One end of intake port 143 is opened downward into hermetic container 101. A volume of gas catcher 144 is 46% of that of compression chamber 119.

Lower end 149 of an opening of gas catcher 144 is located obliquely below lower end 150 of the orifice of suction pipe 109. Angle θ between the horizontal line and the shortest line connecting lower end 149 and lower end 150 is 45°. Inner face 152 of gas catcher 144 is concavely curved to smoothly guide the refrigerant gas to intake port 143.

When motor 103 is powered, compression element 102 operates, and the refrigerant gas is compressed by piston 120 reciprocating inside cylinder 110. In an intake step of compression element 102, the refrigerant gas flows into hermetic container 101 through suction pipe 109 from the low-pressure side of the refrigeration cycle. Since the density of this refrigerant gas is high at low temperatures, the refrigerant gas falls obliquely downward from the orifice of suction pipe 109 into hermetic container 101, and thus gas catcher 144 can efficiently catch the refrigerant gas. The low-temperature refrigerant gas caught by gas catcher 144 is tentatively insulated from an high-temperature atmosphere inside hermetic container 101. The refrigerant gas therefore stays at low temperatures when the refrigerant gas is taken into muffling space 141 through intake port 143.

Accordingly, an intake mass per unit time of the refrigerant gas taken into suction muffler 140, i.e., circulating volume of the refrigerant, increases, achieving better refrigerating capacity and more efficient compressor. The preferred embodiment improves by 3.6% with respect to the refrigerating capacity and 1.3% with respect to COP (Coefficient of Performance) compared to those of the prior art.

Figure 4:
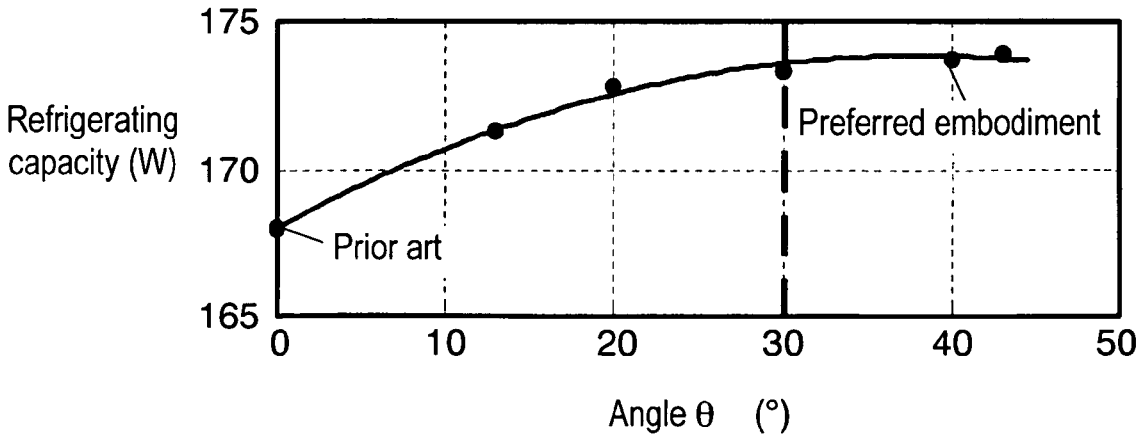
FIG. 4 illustrates a refrigerating capacity characteristic with respect to angle θ shown in FIG. 2.

FIG. 4 is a characteristic curve of the refrigerating capacity of the compressor in the preferred embodiment when the horizontal axis represents angle θ indicated in FIG. 2. As shown in FIG. 4, the refrigerating capacity degrades when angle θ becomes smaller than 30°. Accordingly, angle θ is preferably 30° or larger.

With respect to the upper limit of angle θ, our research reveals that there is no detrimental effect on other characteristics as long as angle θ is 80° or smaller, although it also depends on the shape of gas catcher 144.

Figure 7:
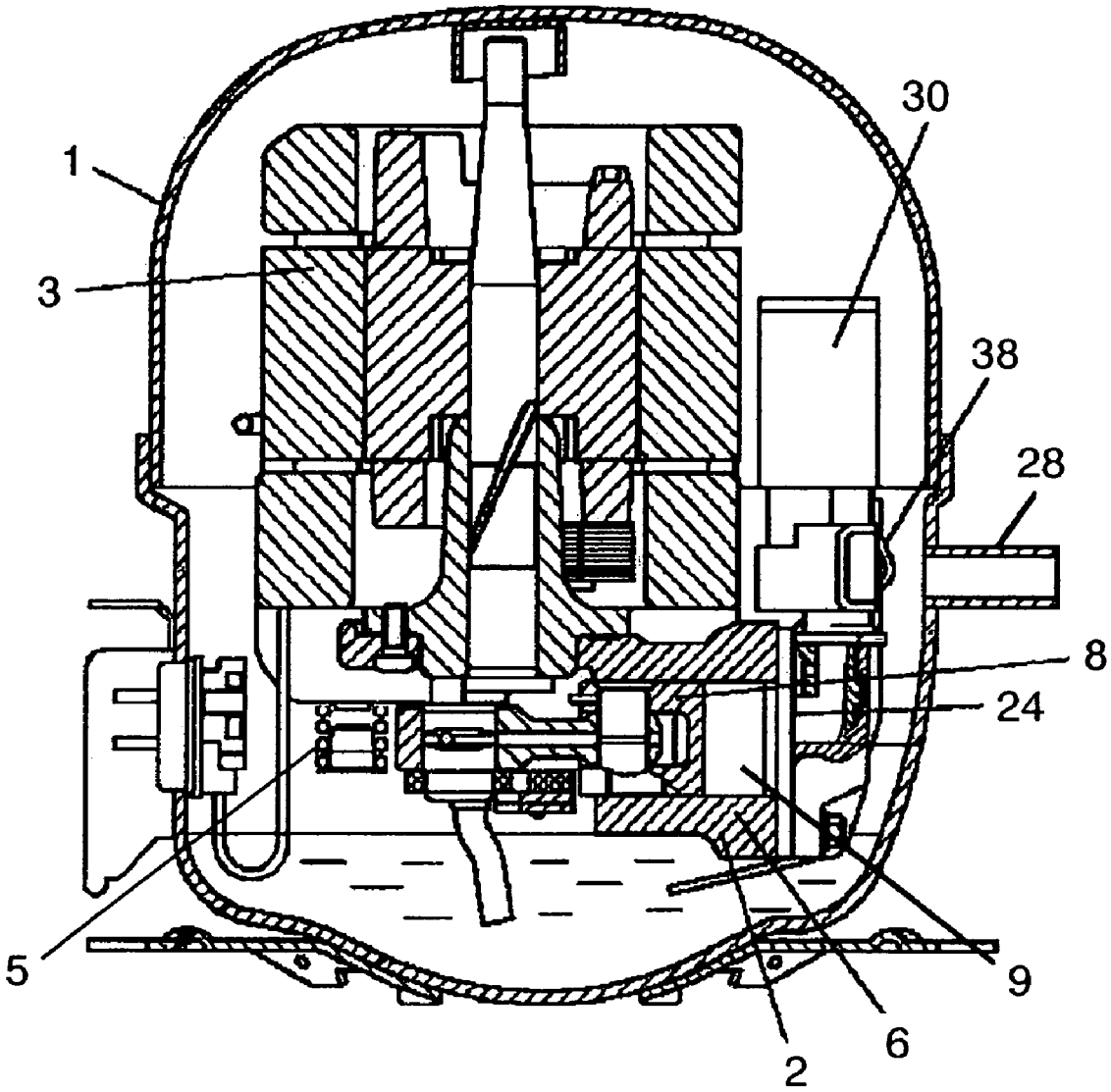
FIG. 7 PRIOR ART
FIG. 7 is a sectional view of a conventional compressor.
Figure 8:
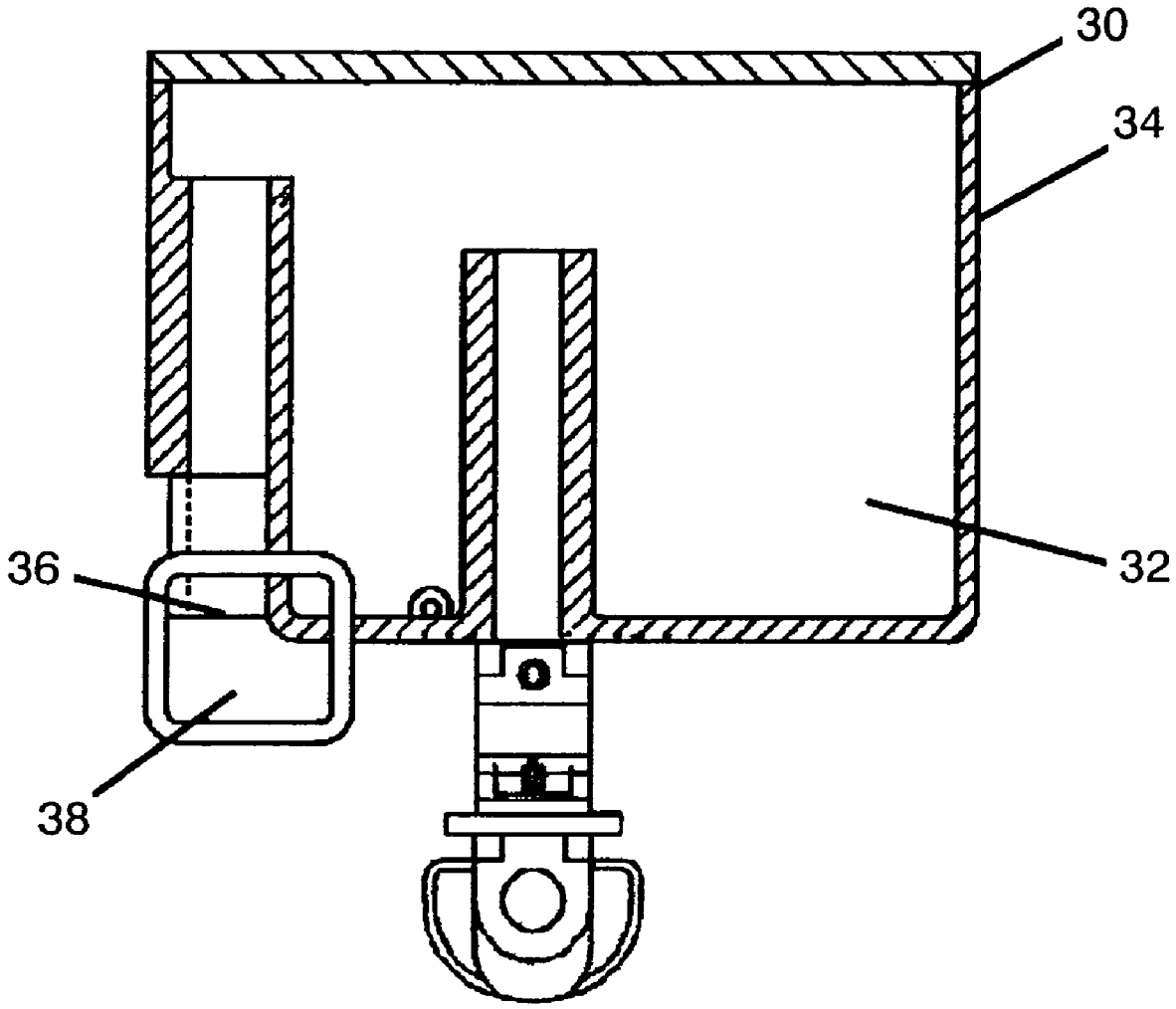
FIG. 8 PRIOR ART
FIG. 8 is a front sectional view of a suction muffler in accordance with the conventional compressor.

In this preferred embodiment, angle θ is 45°, and thus gas catcher 144 can efficiently catch the high-density refrigerant gas at low temperatures from suction pipe 109. This improves the refrigerating capacity and efficiency of the compressor. In the prior art, as shown in FIG. 7, suction pipe 28 and gas catcher 38 are horizontally disposed facing each other, which means angle θ is 0.

Figure 5:
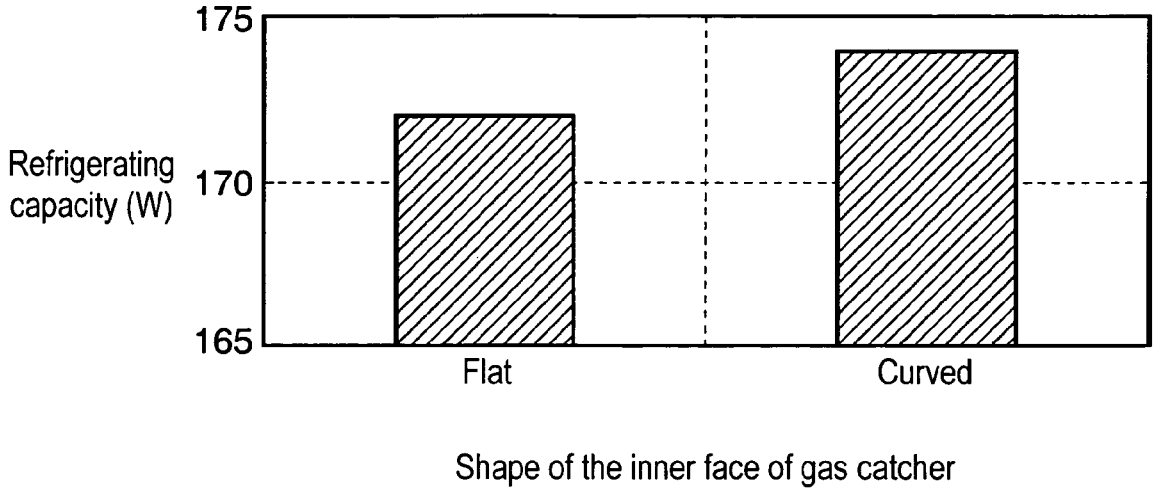
FIG. 5 illustrates a difference in refrigerating capacity by internal shape of a gas catcher of the compressor in accordance with the preferred embodiment of the present invention.

FIG. 5 illustrates the difference in the refrigerating capacity of the compressor in the preferred embodiment between a flat inner face and curved inner face of gas catcher 144. As shown in FIG. 5, the refrigerating capacity apparently improves when the inner face of gas catcher 144 is curved, compared to the flat face. The difference is considered to occur because the low-temperature refrigerant gas caught by gas catcher 144 is smoothly taken through intake port 143 along the curved face with less chance of mixing in ambient high-temperature refrigerant gas.

Figure 6:
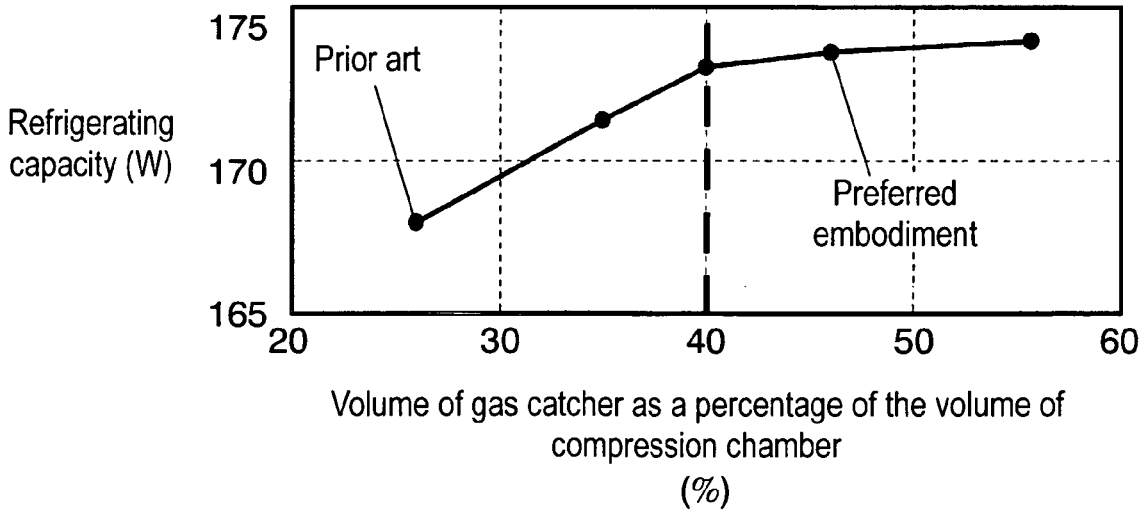
FIG. 6 illustrates a refrigerating capacity characteristic with respect to a volume of the gas catcher of the compressor in accordance with the preferred embodiment of the present invention.

FIG. 6 is a characteristic curve of the refrigerating capacity of the compressor in the preferred embodiment when the horizontal axis represents the volume of gas catcher 144. The refrigerant used is R600a. The volume of gas catcher 144 is indicated as a percentage (%) of the volume of compression chamber 119. As shown in FIG. 6, the refrigerating capacity suddenly drops when the volume of gas catcher 144 becomes smaller than 40%. Accordingly, the volume of gas catcher 144 is preferably 40% or higher.

Our research further reveals that there is no detrimental effect on other characteristics as long as the upper limit of the volume of gas catcher 144 is 150% or smaller.

In the preferred embodiment, the volume of gas catcher 144 is set to 46%. Gas catcher 144 can thus sufficiently receive low-temperature refrigerant gas even when the refrigerant with large specific volume, such as R600a, is used. Consequently, the refrigerating capacity and efficiency of the compressor are improved.

INDUSTRIAL APPLICABILITY

The compressor of the present invention improves the refrigerating capacity and efficiency by drawing low-temperature refrigerant gas into the suction muffler. Accordingly, the present invention is expected to be applied to broad use.

The invention claimed is:

1. A compressor comprising:

a compression element for compressing refrigerant gas;

a hermetic container for accommodating the compression element; and a suction pipe linking inside and outside the hermetic container, wherein the compression element comprises:

a cylinder;

a piston which reciprocates inside the cylinder;

a compression chamber formed in the cylinder; and a suction muffler whose one end leads to the compression chamber, the suction muffler comprising:

a main body forming a muffling space;

an intake port opened to the hermetic container and leading to the muffling space; and a gas catcher surrounding the intake port and having an opening facing an orifice of the suction pipe, wherein the opening of the gas catcher has an upper end located above a lower end of the orifice of the suction pipe and a lower end located below the lower end of the orifice of the suction pipe, the lower end of the opening of the gas catcher defined by a lower surface of the gas catcher, and the intake port has an opening facing the lower surface of the gas catcher, wherein an angle between a horizontal line and a shortest line connecting the lower end of the opening of the gas catcher and the lower end of the orifice of the suction pipe is not less than 30°, and wherein the intake port of the suction muffler is opened downward, and an inner face of the gas catcher is concavely curved.

2. The compressor as defined in claim 1, wherein a volume of the gas catcher is not less than 40% of a volume of the compression chamber.

* * * * *